US006863546B2

(12) United States Patent
Yang et al.

(10) Patent No.: US 6,863,546 B2
(45) Date of Patent: Mar. 8, 2005

(54) CABLE CONNECTOR ASSEMBLY HAVING POSITIONING STRUCTURE

(75) Inventors: Shu-chen Yang, Tu-Chen (TW); Yung-Chien Chung, Tu-Chen (TW); Hsien-Chu Lin, Tu-Chen (TW); Chi-Kai Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/633,150

(22) Filed: Jul. 31, 2003

(65) Prior Publication Data

US 2004/0259395 A1 Dec. 23, 2004

(30) Foreign Application Priority Data

Jun. 18, 2003 (TW) ..... 92211136 U

(51) Int. Cl.[7] ..... H01R 12/00
(52) U.S. Cl. ..... 439/79; 439/352
(58) Field of Search ..... 439/79, 352, 353, 439/358, 357, 606–610, 763, 701, 636, 680, 660, 736, 883

(56) References Cited

U.S. PATENT DOCUMENTS 5,580,268 A * 12/1996 Miyazawa ..... 439/352
6,200,171 B1 * 3/2001 Fusselman et al. ..... 439/736
6,383,010 B1 * 5/2002 Mayo et al. ..... 439/357
6,402,552 B1 * 6/2002 Wagner ..... 439/606
6,439,926 B1 * 8/2002 Kuan ..... 439/607
6,447,340 B1 9/2002 Wu
6,540,542 B1 * 4/2003 Simmel ..... 439/352

* cited by examiner

*Primary Examiner*—P. Austin Bradley
*Assistant Examiner*—Edwin A. Leon
(74) *Attorney, Agent, or Firm*—Wei Te Chung

(57) ABSTRACT

A cable connector assembly (3) includes a housing (31), a number of contacts, a cable (33), and a enclosure (32). The housing has a mating face (310), an outer side face (315), a receiving space (311) defined in the mating face, a number of passageways (312) in communicating with the receiving space, and a guiding post (313) formed on the outer face and extending along the outer face in a mating direction. The contacts are received in the passageways. The cable electrically connects with the contacts. The enclosure encloses the housing, the contacts, and the cable. The closure has an outer side wall (321), and a positioning post (322) formed on the outer side wall and extending in the mating direction of the cable connector assembly.

7 Claims, 5 Drawing Sheets

CABLE CONNECTOR ASSEMBLY HAVING POSITIONING STRUCTURE

BACKGROUND OF THE INVENTION

1. Field of the Invention

The present invention generally relates to a cable connector assembly, and more, particularly to a cable connector assembly having an improved positioning structure.

2. Description of Related Art

Serial ATA (Advanced Technology Attachment) is a disk-interface technology developed by the Serial ATA Working Group. A plug connector defined by a specification which is released by the Serial ATA Working Group generally comprises an insulative housing having a L-shaped mating plate and a guiding groove adjacent to mating plate, and a plurality of plug contacts disposed on a side of the mating plate. A complementary receptacle connector comprises an insulative housing defining a L-shaped receiving space and a guiding post on an end thereof, and a plurality of receptacle contacts received in a side wall of the receiving space and partially exposed in the receiving space. The plug connector is usually mounted on a printed circuit board. The receptacle connector is connected with a cable and embedded by an enclosure to form a cable connector assembly. When the plug connector is mated with the cable connector assembly, the guiding post of the receptacle connector slides into the guiding groove of the plug connector to guide the mating plate into the receiving space. After the mating plate is fully inserted into the receiving space, the guiding post is tightly received in the guiding groove to ensure a reliable mating between the plug and the cable connector assembly.

Sometimes, a standard plug connectors is needed to mate with another standard receptacle connector of a cable connector assembly. Since the standard receptacle connector is not initially designed to mate with the standard plug connector, dimension of the guiding post of the standard receptacle connector usually does not conform with dimension of the guiding groove of the standard plug connector, so the guiding post can not accurately guide the mating plate of the standard plug connector into the receiving space of the standard receptacle connector. In addition, when the mating plate is fully inserted into the receiving space, the guiding post is not tightly received in the guiding groove, so the cable connector assembly is apt to inadvertently move relative to the standard plug connector by improperly operating, thereby adversely affecting the mating between the standard plug connector and the cable connector assembly.

Hence, an improved positioning structure between the plug connector and the cable connector assembly is desired.

SUMMARY OF THE INVENTION

An object of the present invention is to provide a cable connector assembly having an improved positioning structure which ensures the cable connector assembly is reliably mated a complementary connector.

To achieve the above object, a cable connector assembly in accordance with the present invention comprises a housing, a plurality of contacts, a cable, and an enclosure. The housing has a mating face, an outer side face, a receiving space defined in the mating face, a plurality of passageways in communicating with the receiving space, and a guiding post formed on the outer face and extending along the outer face in a mating direction of the housing. The contacts are received in the passageways. The cable electrically connects with the contacts. The enclosure encloses the housing, the contacts, and the cable. The enclosure has an outer side wall, and a positioning post formed on the outer side wall and extending in the mating direction of the housing.

Other objects, advantages and novel features of the invention will become more apparent from the following detailed description when taken in conjunction with the accompanying drawings.

DETAILED DESCRIPTION OF THE INVENTION

Figure 1:
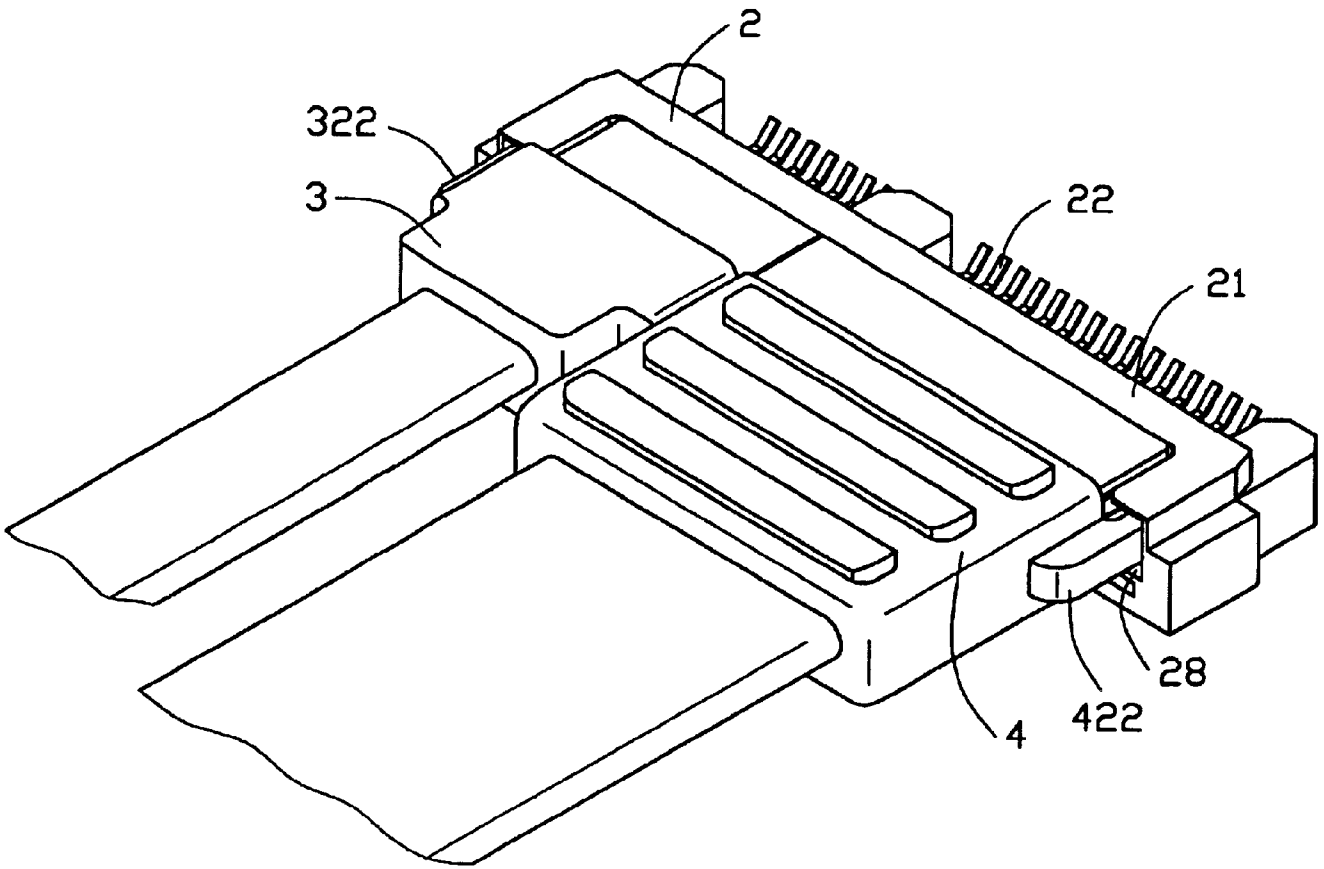
FIG. 1 is a perspective view of a first and a second cable connector assemblies in accordance with the present invention mated with a plug connector.

Referring to FIG. 1, a first and a second connector assemblies 3, 4 in accordance with the present invention are mated with a plug connector 2.

Figure 2:
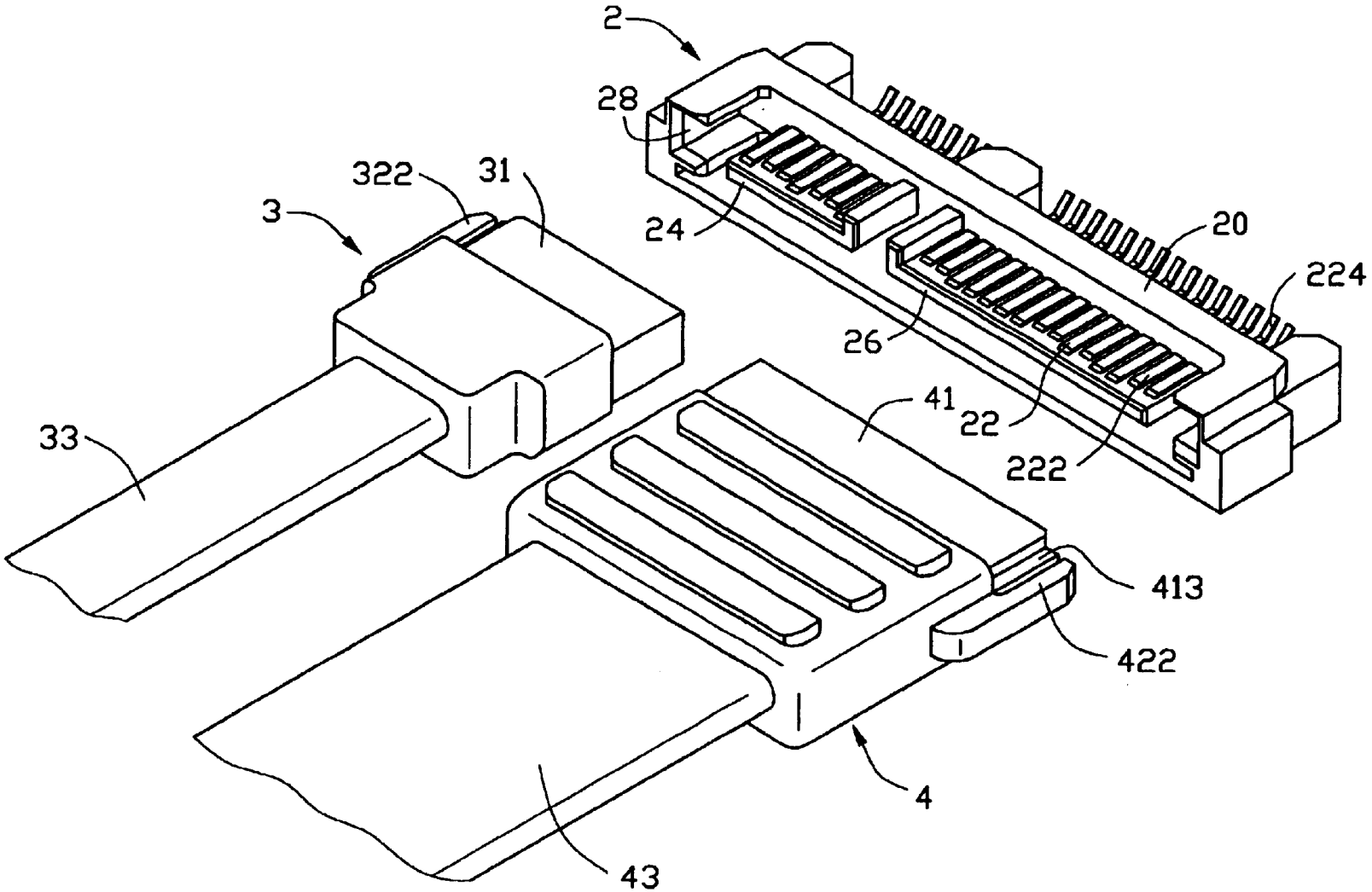
FIG. 2 is a view similar to FIG. 1 but the first and second cable connector assemblies are unmated from the plug connector.

Referring to FIG. 2, the plug connector 2 comprises a plug housing 20 and a plurality of plug contacts 22 received in the plug housing 20. The plug housing 20 has a first and a second L-shaped mating plates 24, 26 arranged side by side. Each plug contact 22 comprises a mating portion 222 positioned on an upper side of the mating plate and a tail portion 224 extending rearwardly away from the plug housing 20. A first and a second grooves 28 are formed on a first and a second ends of the plug housing 20 and adjacent to the mating plates 24, 26, respectively.

Figure 3:
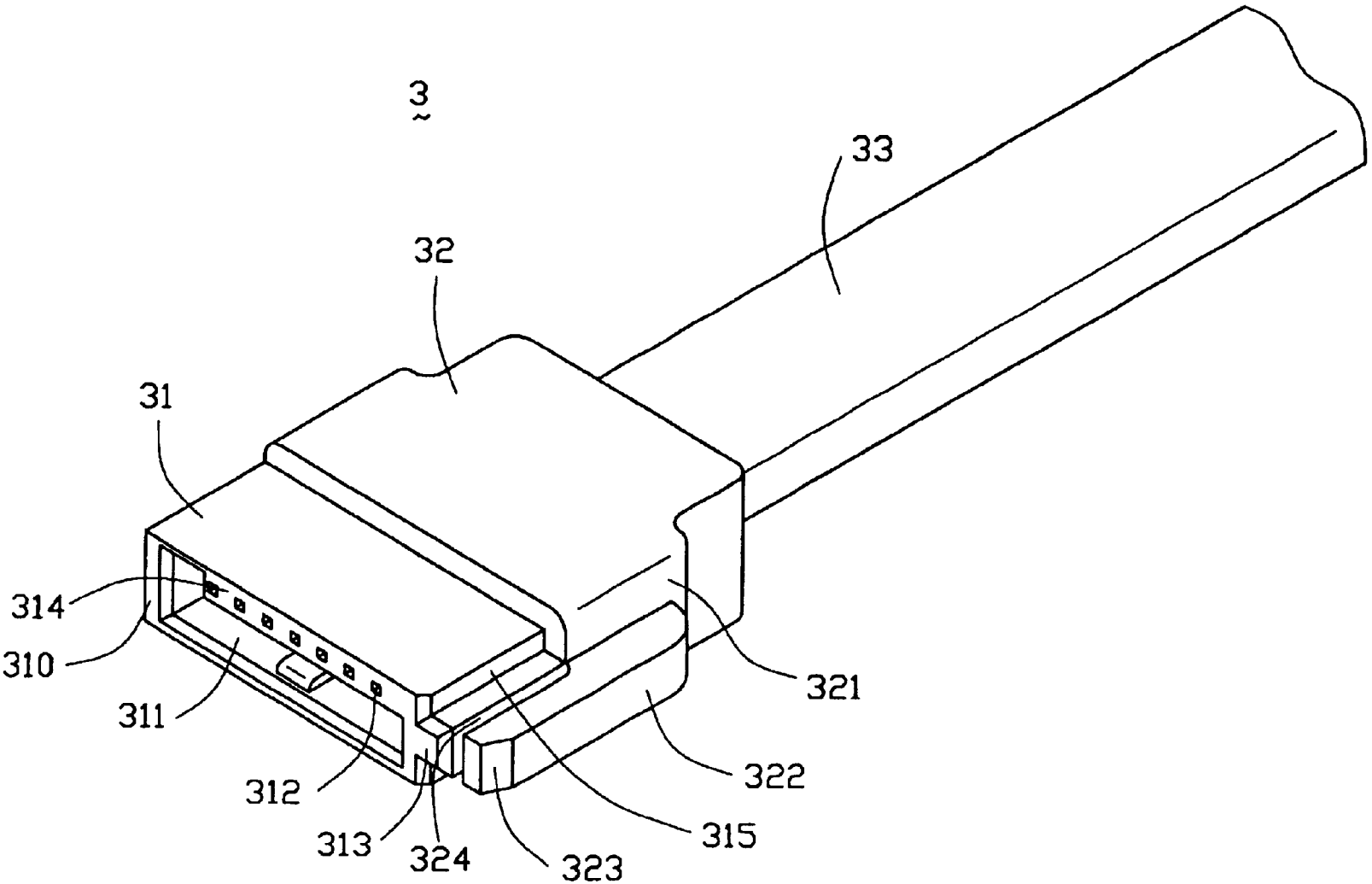
FIG 3 is a perspective view of the first cable connector assembly of FIG. 1 but taken from a different aspect.

Referring to FIG. 3 in conjunction with FIG. 2, the first cable connector assembly 3 comprises a first housing 31 having a first mating face 310 and a first outer side face 315, a plurality of first contacts (not shown), a first enclosure 32 and a first cable 33. The first housing 31 defines a first L-shaped receiving space 311 in the first mating face 310 for receiving the first L-shaped mating plate 24, and a plurality of first passageways 312 in a first top wall 314 of the first receiving space 311 and communicating with the first receiving space 311. The first housing 31 is formed with a first guiding post 313 on the first outer side face 315 of the first housing 31. The first guiding post 313 extends along the first outer side face 315 in a mating direction of the first housing 31 and not beyond the first mating face 310 of the first housing 31. The first contacts are received in the first passageways 312 and partially exposed in the first receiving space 311 for contacting with the mating portion 222 positioned on the upper side of the first mating plate 24. The first cable 33 comprises a plurality of first wires (not shown) electrically connected with rear ends of the first contacts in ways known to persons skilled in the pertinent art. The first enclosure 32 embeds the ends of the first housing 31, the first contacts and the first cable 33 therein with the cable 33 extending along the mating direction of the first housing 31.

The first enclosure 32 is formed with a first positioning post 322 on a first outer side wall 321. The first positioning post 322 extends forwardly in the mating direction of the first housing 31 but not beyond the first mating face 310 of the first housing 31. The first positioning post 322 is adjacent and substantially parallel to the first guiding post 313 and a first slot 324 is formed therebetween. The first positioning post 322 has a first lead-in face 323 on a free end thereof.

Figure 4:
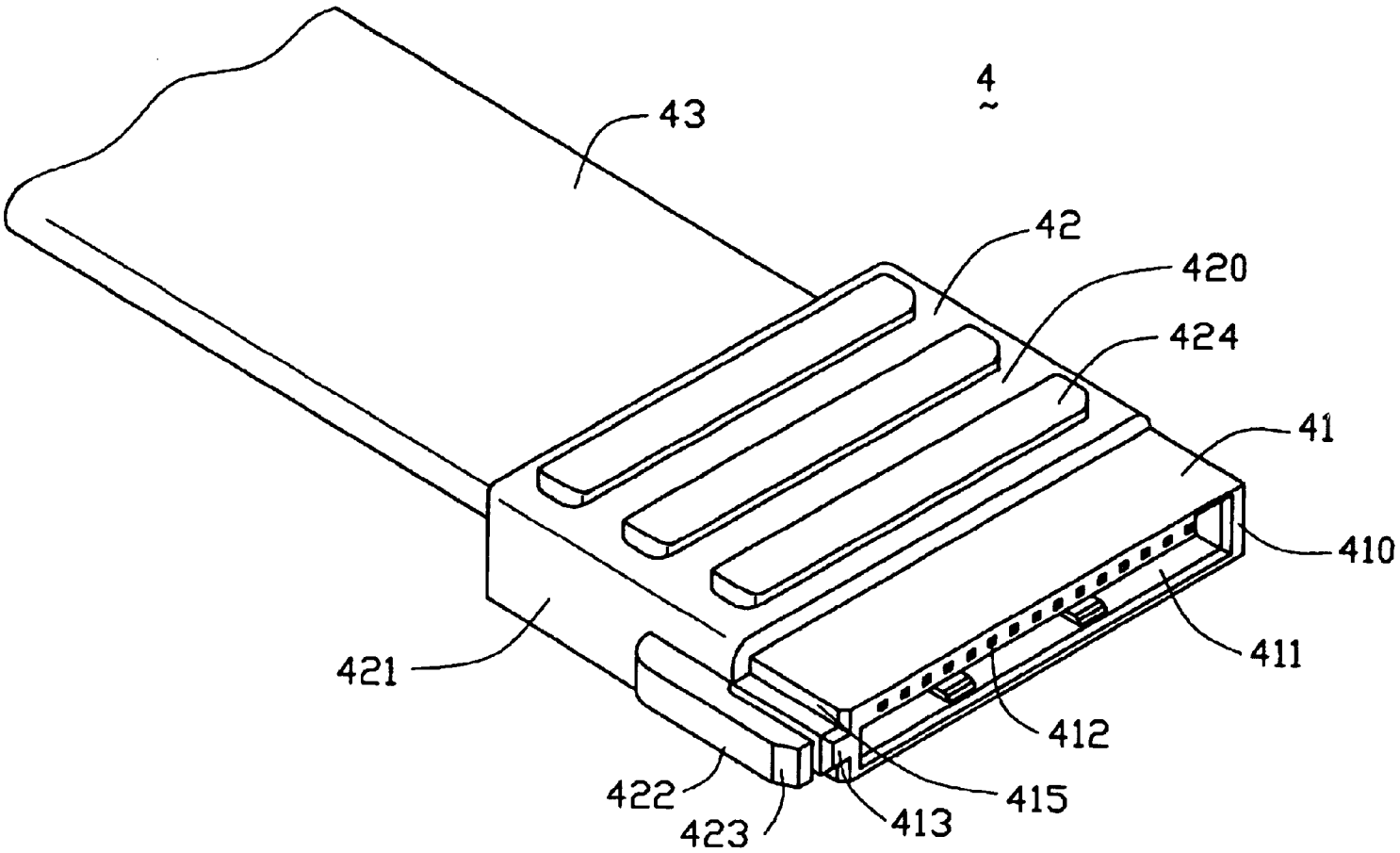
FIG. 4 is a perspective view of the second cable connector assembly of FIG. 1 but taken from a different aspect.

Referring to FIG. 4 in conjunction with FIG. 2, the second cable connector assembly 4 is identical in configuration and structure to the first cable connector assembly 3 except a plurality of ribs 424 are formed on a second upper face 420 of a second housing 41.

Referring to FIG. 1 again, when the first and the second cable connector assemblies 3, 4 are mated with the plug connector 2, the first and second mating plates 24, 26 of the plug connector 2 are received in the first and second receiving paces 311, 411 of the first and second cable connector assemblies 3, 4, respectively. The first guiding post 313 and the first positioning post 322 are received in the first groove 28 on the first end of the plug housing 20, and the second guiding post 413 and the second positioning post 422 are received in the second groove 28 on the second end of the plug housing 20. Since the first slot 324 is formed between the first guiding post 313 and the first positioning post 322, the first positioning post 322 deflects inwardly and tightly abuts against an inner side of the first groove 28 to secure a reliable mating between the first cable connector assembly 3 and the plug connector 2. The second cable connector assembly 4 is also reliably mated with the plug connector 2 by the second positioning post 422 tightly abutting against an inner side of the second groove 28.

Figure 5:
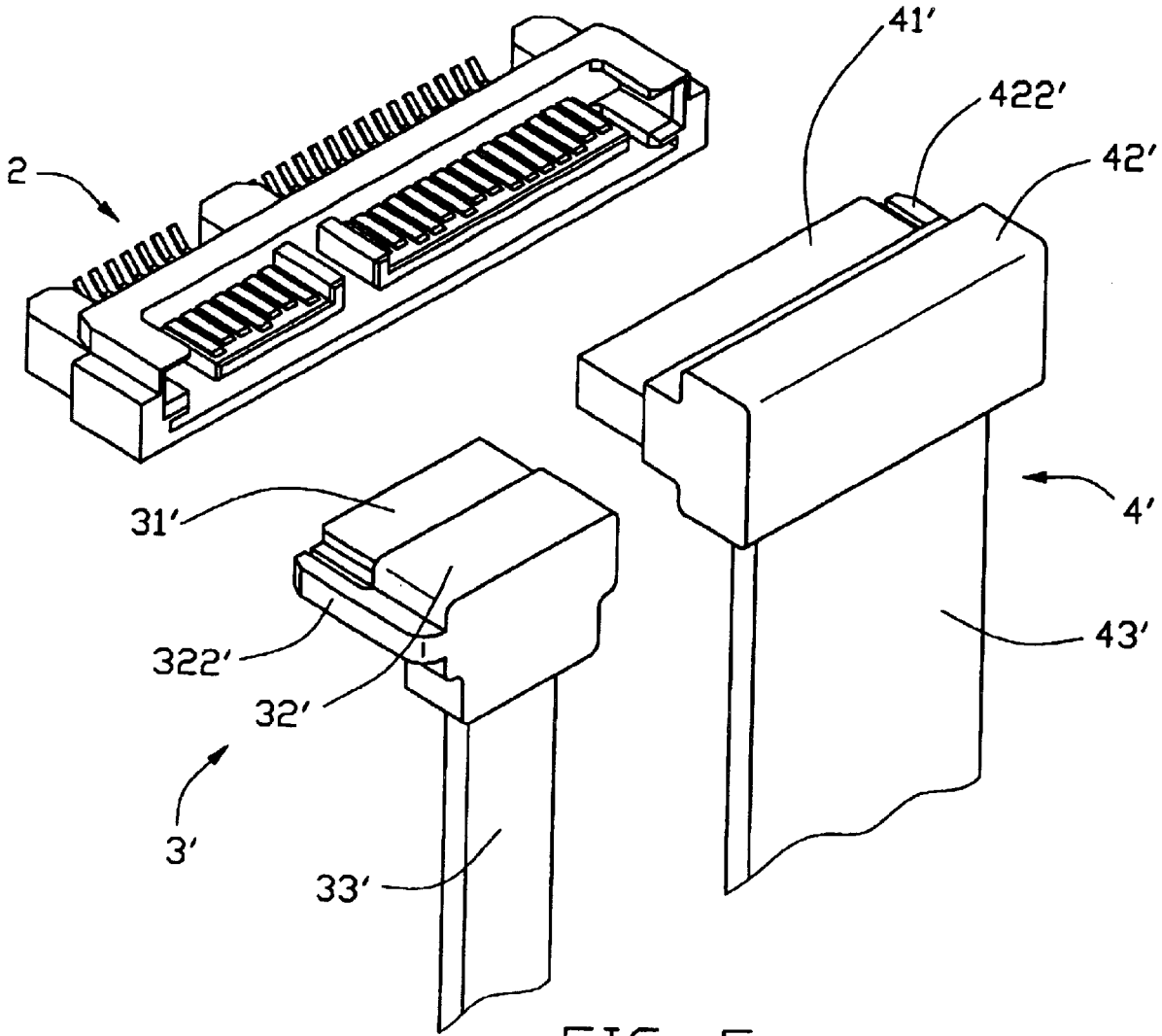
FIG. 5 is a perspective view of a first and a second cable connector assemblies in accordance with a second embodiment of the present invention mated with a plug connector.

Referring to FIG. 5, a third and a fourth cable connector assemblies 3', 4' in accordance with a second embodiment of the present invention are disclosed, the difference between the first and second cable connector assemblies 3, 4 and the third and fourth cable connector assemblies 3', 4' is that a third and a fourth cables 33', 43' of the third and fourth cable connector assemblies 3', 4' extend in directions which are perpendicular to mating directions of the third and fourth housings 31', 41'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic assembly comprising:

a plug connector comprising a plug housing and a plurality of plug contacts received in the plug housing, the plug housing defining a first and a second grooves on a first and a second ends thereof;

a first cable connector assembly comprising a first housing having a first outer face and a first guiding post formed on the first outer face and extending along the outer face in a mating direction of the first housing, a plurality of first contacts received in the first housing, a cable electrically connecting with the first contacts, and a first enclosure enclosing the first housing, the first contacts and the first cable, the first enclosure being formed with a first positioning post on a first outer side wall thereof and extending parallelly to the first guiding post the first guiding post and the first positioning post being received in the first groove of the plug housing; and a second cable connector assembly comprising a second housing having a second outer face and a second guiding post formed on the second outer face and extending along the outer face in a mating direction of the second housing, a plurality of second contacts received in the second housing, a cable electrically connecting with the second contacts, and a second enclosure enclosing the second housing, the second contacts and the second cable, the second enclosure being formed with a second positioning post on a second outer side wall thereof and extending parallelly to the second guiding post, the second guiding post and the second positioning post being received in the second groove of the plug housing.

2. An electrical connector assembly comprising:

a board mount connector including a first insulative elongated housing defining a mating plate with a groove extending, along a front-to-back direction, in an inner face of an end wall opposite to said mating plate along a longitudinal direction perpendicular to said front-to-back direction;

a plurality of first contacts disposed on the mating plate;

a cable connector assembly including a second insulative elongated housing configured to be compliantly received in the first housing and defining a receiving space compliantly receiving the said mating plate therein;

a plurality of second contacts disposed in the receiving space and engaged with the corresponding first contacts, respectively;

a cable linked to a rear end of the cable connector assembly; and a guiding post integrally formed on one end of the second housing; wherein said cable connector further includes a forwardly extending positioning post spatially located outside of the guiding post in said longitudinal direction, a front portion of said positioning post is deflectably received in groove.

3. The assembly as claimed in claim 2, wherein said positioning post extends forwardly from an over-molded cover located behind the second housing, said cover being longer than the second housing along said longitudinal direction.

4. The assembly as claimed in claim 2, wherein said positioning post is inwardly deflected in said longitudinal direction for provision of retention between the board mount connector and the cable connector assembly.

5. The assembly as claimed in claim 4, wherein said positioning post is configured corresponding to the groove to perform both retention and guiding functions.

6. The assembly as claimed in claim 2, wherein said first housing further includes another, mating plate with a plurality of third contacts thereon, and another groove is formed in an inner face of the other end wall.

7. The assembly as claimed in claim 6, wherein another cable connector assembly includes a third housing with another deflectable positioning post spatially located aside and retainably received in said another groove, said positioning post and said another positioning post being essentially located respectively at two opposite farthest end sections, in said longitudinal direction, of both said cable connector assembly and said another cable assembly.

* * * * *